United States Patent [19]

Brudy

[11] 4,054,792

[45] Oct. 18, 1977

[54] LAMP

[75] Inventor: Peter E. Brudy, West Hill, Canada

[73] Assignee: Dominion Auto Accessories Limited, Toronto, Canada

[21] Appl. No.: 661,441

[22] Filed: Feb. 26, 1976

[51] Int. Cl.[2] ..... F21M 3/00

[52] U.S. Cl. ..... 362/267

[58] Field of Search ..... 240/41.3, 41.55, 106.1, 240/47, 25, 41 R, 103 R, 7.1 R, 46.57, 46.59, 41 SB, 41 SC

[56] References Cited

U.S. PATENT DOCUMENTS

| | | | |
|---|---|---|---|
| 2,903,570 | 9/1959 | Worden | 240/46.57 X |
| 3,222,512 | 12/1965 | Dickson | 240/41.55 X |
| 3,321,618 | 5/1967 | Goldbaum et al. | 240/41.55 |
| 3,558,872 | 1/1971 | Hough et al. | 240/41.55 X |
| 3,968,358 | 7/1976 | Baader | 240/41.3 X |

FOREIGN PATENT DOCUMENTS

| | | | |
|---|---|---|---|
| 2,232,817 | 1/1973 | Germany | 240/46.59 |

*Primary Examiner*—Edna M. O'Connor

*Attorney, Agent, or Firm*—Barnes, Kisselle, Raisch & Choate

[57] ABSTRACT

A lamp comprising a body having an axially extending inwardly facing surface and an annular radial surface extending radially inwardly with respect to the axially extending surface. An annular seal is mounted on the radial surface. A lens has a light transmitting wall and an annular wall extending axially with respect to the light transmitting wall into the body. The axial end of the annular wall of the lens has a groove therein into which the annular seal extends.

14 Claims, 6 Drawing Figures

LAMP

This invention relates to lamps.

BACKGROUND OF THE INVENTION

In lamps utilized for marking, signalling and the like in automotive vehicles, it is common to provide a housing and lens with some type of seal therebetween. Such applications include carriers of dusty, corrosive or flammable materials. In some instances, the seal is provided for the protection of the internal components of the lamp. In other applications, such as fuel tankers, the seal is utilized to prevent flammable or explosive vapors from reaching the electrical contacts of the lamp.

Heretofore, the most common construction comprised a housing and a lens having telescoping portions with a resilient seal interposed therebetween. In some types, the lens is retained in position by the interrelationship of the components. Typical of such a construction are the lamps described in U.S. Pat. Nos. 3,244,869, 3,096,026 and 2,707,747.

These earlier devices shared one common failure point, and this was the sealing area. Due to the variations in thermal expansion between a plastic lens, a rubber sealing ring and a metal housing, the assembly tended to loosen in elevated temperature service, and to "lock-up" in low temperature service. In sub-zero temperatures, such lamps were virtually impossible to service and required that the lens be broken for a simple change of bulb.

Consequently, the objects of this invention comprise the provision for a lamp which may be readily serviced, without tools, at both elevated and sub-zero temperatures. Further, it is an object of this invention to provide a lens/housing engagement which is not adversely affected by climatic conditions. Still further, it is an object to provide a lens, housing and interposed seal providing a satisfactory locking means without the necessity of extremely close tolerances.

Further objects include the provision for a lamp utilizing a low-cost molded seal, which may be easily manufactured, assembled and serviced as required.

SUMMARY OF THE INVENTION

In accordance with the invention, the lamp comprises a body having an axially extending inwardly facing surface and an annular radial surface extending radially inwardly with respect to the axial surface. An annular seal is mounted on the radial surface. A lens has a light transmitting wall and an annular wall extending axially with respect to the light transmitting wall into the body. The axial end of the annular wall of the lens has a groove therein into which the annular seal extends.

DESCRIPTION

Figure 1:
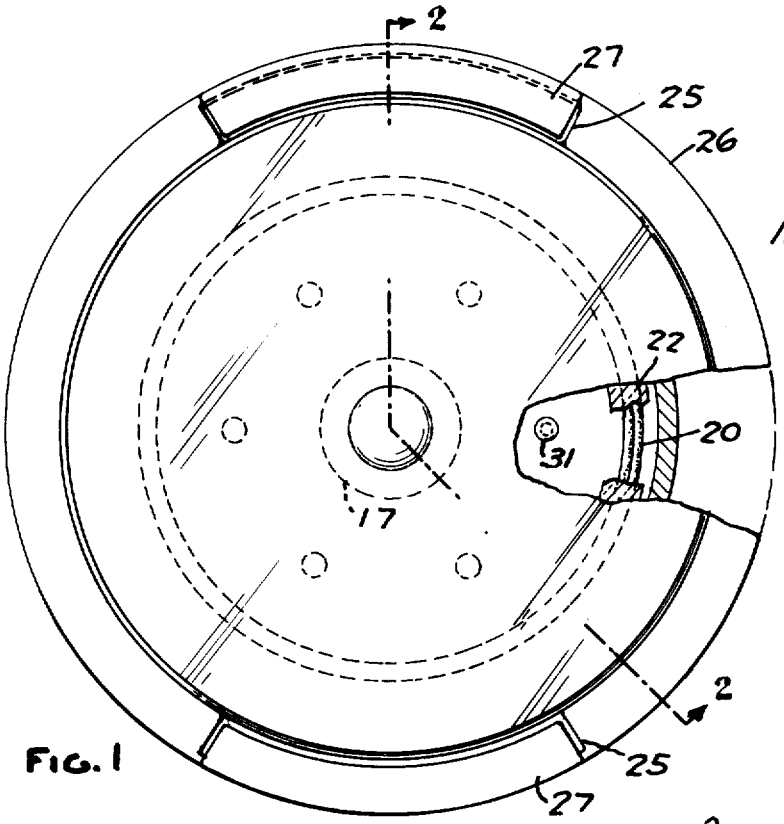
FIG. 1 is a part sectional plan view of a lamp embodying the invention.
Figure 2:
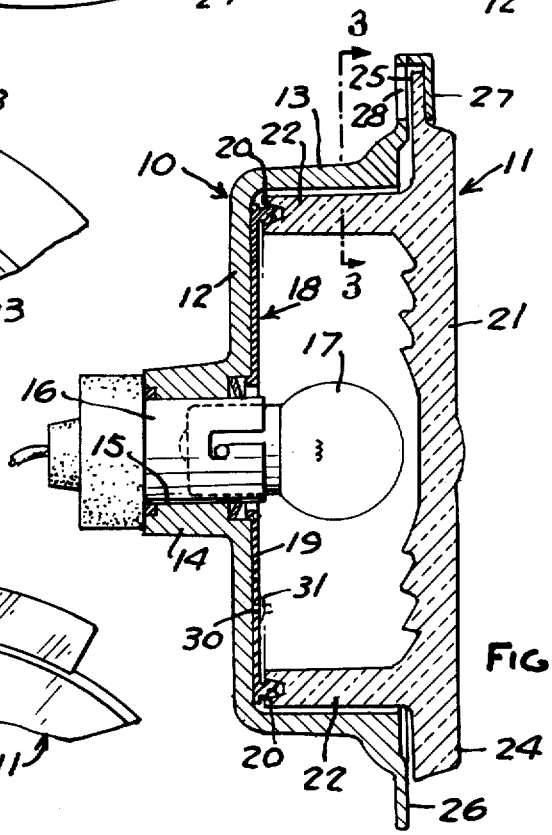
FIG. 2 is a sectional view taken along the line 2—2 in FIG. 1.
Figure 4:
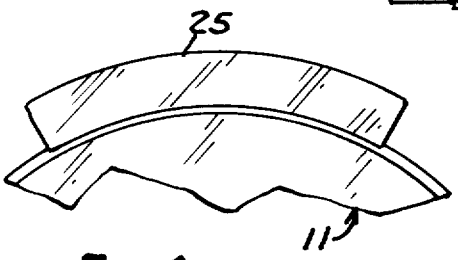
FIG. 4 is a fragmentary plan view of a portion of the lens.

Referring to FIGS. 1 and 2, the lamp embodying the invention comprises a housing 10 and a lens 11. The housing 10 is made of plastic and includes a base wall 12 extending radially and a peripheral wall 13 with a central boss 14 having an opening 15 to receive the socket 16 that holds the bulb 17.

A seal 18 is provided on the inner surface of the base wall 12 and includes a first thin flat portion 19 co-extensive with the inner surface of the base wall and a second annular axially extending portion 20 which is heart-shaped and enlarged in cross section.

Figure 5:
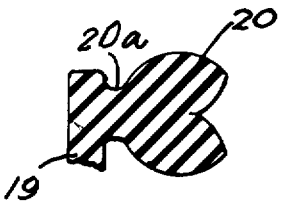
FIG. 5 is a fragmentary sectional view of a portion of FIG. 2.
Figure 6:
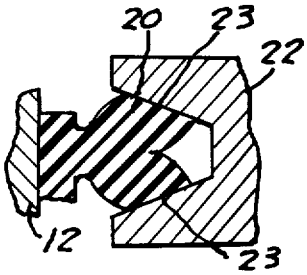
FIG. 6 is a fragmentary sectional view on an enlarged scale of a portion of FIG. 2.
Figure 3:
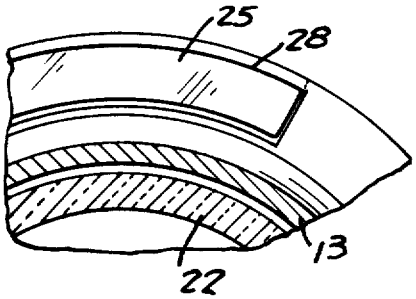
FIG. 3 is a fragmentary sectional view taken along the line 3—3 in FIG. 2.

The lens 11 includes a light transmitting generally flat wall 21 and an axially extending wall 22 telescoped within the peripheral wall 13 and spaced therefrom. The end of the annular wall 22 includes a generally rectangular groove 23 having inwardly tapered sidewalls into which the enlarged portion 20 of the resilient sealing member 18 extends to provide a seal and also yieldingly urge the lens axially outwardly with respect to the seal. The lens further includes an annular portion 24 extending beyond the peripheral portion 13 with circumferentially extending diametrically opposed lips 25. The housing includes a peripheral flange 26 that has a return radially inwardly extending portion 27 beneath which the lips 25 of the lens can extend by a rotating movement of the lens. To facilitate fabrication in a mold, the flange 26 has openings 28 that are aligned with the lips or portions 27 through which portions of a mold extend during the molding. Sealing member 18 preferably comprises a ring connected to the flat portion 19 by an annular neck portion **20*a* having a heart-shaped cross section defining outwardly extending lips (FIG. 5) which are compressed toward one another when the sealing member 18 is placed in groove 23 (FIG. 6**).

In order to hold the seal 18 in position, the first position 19 is formed with openings 30 through which projections 31 integral with the base wall extend and with the free ends thereof deformed by heat or pressure to hold the seal 18 in position.

The lens 11 can be readily applied and removed by a rotating movement with respect to the housing.

I claim:

1. In a lamp, the combination comprising a body having an axially extending inwardly facing surface, and an annular radial surface extending radially inwardly with respect to said axial surface, a resilient annular seal mounted on said radial surface and extending axially therefrom, a lens, said lens having a light transmitting wall and an annular wall extending axially with respect to said light transmitting wall into said body, the axial end of said annular wall having a groove therein into which said annular seal extends, and means on said body for engaging said lens and urging said annular wall axially against said seal.

2. The combination set forth in claim 1 wherein said annular seal also comprises a first base portion extending along said annular surface.

3. The combination set forth in claim 2 wherein said axially extending portion of said seal is heart shaped in cross section.

4. The combination set forth in claim 3 wherein said groove is generally rectangular in cross section with inwardly tapered side walls.

5. The combination set forth in claim 1 wherein said annular seal which extends into said groove is heart shaped in cross section.

6. The combination set forth in claim 5 wherein said groove is generally rectangular in cross section with inwardly tapered side walls.

7. The combination set forth in claim 1 wherein said seal includes circumferentially spaced openings, said housing having portions thereof extending through said openings and deformed to hold said seal in position.

8. The combination set forth in claim 1 wherein said annular surface forms a portion of a base of said body.

9. In a lamp, the combination comprising a body having a peripheral wall defining an axially extending inwardly facing surface, a bottom wall having an annular radial surface extending radially inwardly with respect to said axial surface, a resilient annular seal mounted on said radial surface and extending axially therefrom, a lens, said lens having a light transmitting wall and an annular wall extending axially with respect to said light transmitting wall in telescoping relation to said peripheral wall into said body, the axial end of said annular wall having a groove therein into which said annular seal extends, and means on said body for engaging said lens and urging said annular wall axially against said seal.

10. The combination set forth in claim 9 wherein said annular seal also comprises a first portion extending along said annular surface.

11. The combination set forth in claim 10 wherein said axially extending portion of said seal is heart shaped in cross section.

12. The combination set forth in claim 11 wherein said groove is generally rectangular in cross section with inwardly tapered side walls.

13. The combination set forth in claim 9 wherein said annular seal which extends into said groove is heart shaped in cross section.

14. The combination set forth in claim 13 wherein said groove is generally rectangular in cross section with inwardly tapered side walls.

* * * * *